US007627911B1

(12) United States Patent
Traykov et al.

(10) Patent No.: US 7,627,911 B1
(45) Date of Patent: Dec. 8, 2009

(54) METHOD AND APPARATUS FOR HANDLING A PERSON

(76) Inventors: Ivo Traykov, 4047 S. Waterbridge Cir., Port Orange, FL (US) 32129; Silvia Sarafova, 4047 S. Waterbridge Cir., Port Orange, FL (US) 32129; Francis Walters, 13262 Oulton Cir., Orlando, FL (US) 32832

( * ) Notice: Subject to any disclaimer, the term of this patent is extended or adjusted under 35 U.S.C. 154(b) by 0 days.

(21) Appl. No.: 12/248,205

(22) Filed: Oct. 9, 2008

(51) Int. Cl.
*A61G 7/10* (2006.01)

(52) U.S. Cl. ..... 5/81.1 R

(58) Field of Classification Search ..... 5/81.1 R, 5/81.1 T, 658, 1
See application file for complete search history.

(56) References Cited

U.S. PATENT DOCUMENTS 3,967,329 A 7/1976 Whitton, Jr. et al.
4,829,612 A 5/1989 Adams
4,944,057 A 7/1990 Shaw
5,054,137 A 10/1991 Christensen
5,297,834 A 3/1994 Vanarnem
5,711,044 A 1/1998 Newman et al.
6,175,973 B1 1/2001 Hakamiun et al.
6,615,432 B1 9/2003 Blaylock
6,961,967 B1 11/2005 Brown

*Primary Examiner*—Alexander Grosz
(74) *Attorney, Agent, or Firm*—Bruce E. Weir

(57) ABSTRACT

A lightweight, portable frame allows a caregiver to fix one or two of the caregiver's lower legs and knees in position with respect to one or two of a patient's lower legs and knees so that the fixed lower legs together support and balance the combined body weight of the caregiver and patient, allowing the caregiver to pivot the patient up or down from a seated position by using the fixed knees as a fulcrum. The frame has a lower section with a central concavity that engages one person's leg below the knee from one direction, and peripheral concavities on either side of the central concavity that engage another person's legs below the knee from the opposite direction. Legs in the peripheral concavities partially straddle the leg in the central concavity. The frame is strapped onto the patient with an upper portion of the frame braced against the patient's upper leg.

19 Claims, 6 Drawing Sheets

METHOD AND APPARATUS FOR HANDLING A PERSON

BACKGROUND

People who are injured, ill, aged, or in some way disabled often have difficulty changing position, particularly in moving between sitting and standing positions or from one surface to another. An individual's capabilities may change from hour to hour in response to pain, medication, medical precautions and contraindications, the acuteness of the person's condition, the person's emotional state and many other factors. A caregiver must therefore act cautiously each time a patient is moved, protecting both the patient and the caregiver. The caregiver should be able to closely monitor the patient's movement, provide verbal guidance, assist when needed, and intervene to prevent injury.

One way to provide this level of support is to strap the patient into an apparatus capable of independently lifting and supporting the patient's entire weight. The patient may then be raised to or lowered from a standing position, or swung or rolled into a new sitting position. Such devices often incorporate a large metal frame with hydraulic actuators. These may provide excellent control over the patient's position while minimizing exertion by the caregiver, but they are expensive, require considerable operating space, are difficult to move and time-consuming to set up. Busy caregivers who assist many patients seldom have time to struggle with large, complex lifting devices, especially when care requires travel between patients.

Many lighter and simpler lifting devices have been developed, ranging from pivoting posts mounted on platforms to straps that may be attached to a patient to give a caregiver a better grip on the patient. Though more portable than a hydraulic lift, a post mounted on a platform is still awkward to move about and may require more upper body strength than a patient can reliably muster. A simple strap or a strap with an attached grip is easy to transport and attach but forces the caregiver to provide most or all lifting and stabilization force.

Without the help of a device that provides stability and a mechanical advantage, a caregiver who lifts and assists patients must engage in strenuous motions in awkward, unbalanced positions and may suffer consequent work-related injuries, especially when these activities are repeated many times within a short period. According to the Occupational Safety and Health Administration (OSHA), a caregiver who assists a patient who is standing up, sitting down, or transferring laterally to another place is at risk for work-related musculoskeletal disorders (MSDs) such as back injuries, which account for one-third of all occupational injuries and illnesses reported to the Bureau of Labor Statistics (BLS) by employers every year. These are common, expensive and preventable injuries.

What is needed is a light, portable, inexpensive device that addresses OSHA concerns by decreasing the force a caregiver must use to move a patient and by eliminating the awkward postures required by other methods; that provides constant, direct contact between caregiver and patient, allowing the caregiver to control the patient and his/her movement and ensure a constant level of safety at any given time; and that is sufficiently easy to use, light, portable, and inexpensive that it can be routinely employed.

SUMMARY

The inventive apparatus is generally a structure that, when placed against at least one of an assisted person's legs and braced with opposing force from at least one of an assisting person's legs, holds the assisted person's knee or knees steady while allowing the assisting person to use the assisting person's body weight to balance the assisted person's body weight over a fulcrum formed by the knees of both people. The assisted person may then be more easily lifted from or lowered to a seated position, shifted laterally to a different position, stabilized, or otherwise handled.

One embodiment of the apparatus is a frame with a lower member having a central concavity opening in one direction and two peripheral concavities opening in the opposite direction. Each concavity is sized to accept a person's leg below the knee. A leg inserted in the central concavity is at least partially straddled by legs inserted in the peripheral concavities. An upper member attached by side members braces against the leg above the knee. Another embodiment may be a panel with opposing central and peripheral concavities that accept knees.

The peripheral concavities engage the legs of a two-legged patient, or the central concavity engages the leg of a one-legged patient. The apparatus may be strapped in place on the patient before a caregiver engages the apparatus. When assisting a two-legged person a caregiver engages the central concavity. When assisting a one-legged person the caregiver engages the peripheral concavities. In any case, the caregiver faces the patient and engages the apparatus from a direction opposite the patient's. Opposing force against central and peripheral concavities fixes the engaged legs of the caregiver and patient in position.

The caregiver may then directly or indirectly grasp the patient's upper body and use the caregiver's body weight to balance the patient's weight over the engaged knees. The caregiver may then rock backward to move the patient to a standing position or forward to move the patient to a seated position.

Since the apparatus is light, inexpensive, and easy to manufacture, use, clean, and transport, the apparatus may be used effectively in a far wider variety of circumstances than existing devices and methods. All of these features and advantages are illustrated below in the drawings and detailed description that follow.

DETAILED DESCRIPTION

Since the inventive apparatus and related methods of use are most often employed during the provision of health care, the assisting person will hereafter be referred to as a caregiver and the assisted person as a patient, with the understanding that the invention is not limited to medical applications and the people utilizing the invention are not necessarily patients or health care providers.

Several embodiments of the invention have been found to be useful. Each has one concavity flanked on either side by at least two opposing concavities to form at least in part a shape roughly resembling a letter "M" or "W."

Figure 1:
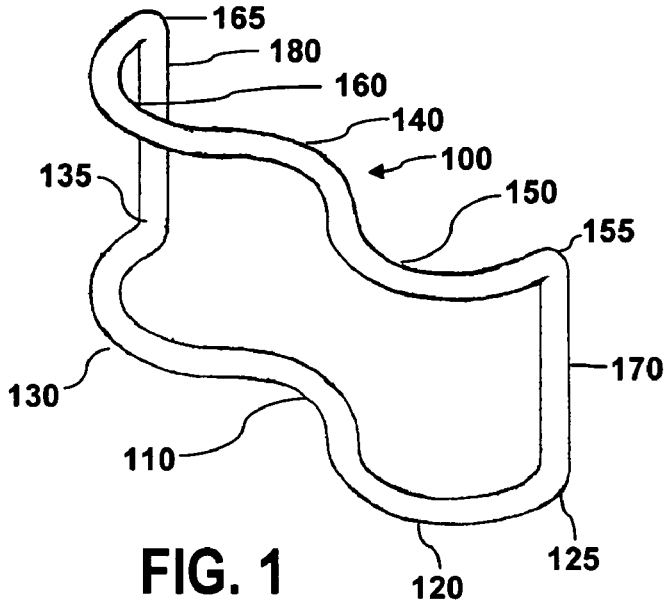
FIG. 1 shows a perspective view of an embodiment fabricated from cylindrical stock to form a frame.

FIG. 1 shows a perspective view of an embodiment 100 fabricated from cylindrical stock to form a frame. The rounded curve of a lower central concavity 110 reverses at each end to form opposing right 120 and left 130 lower peripheral concavities. A parallel upper central concavity 140 similarly reverses at each end to form opposing right 150 and left 160 upper peripheral concavities. The outer end 125 of the right lower peripheral concavity 120 is joined by a right side member 170 to the outer end 155 of the right upper peripheral concavity 150. The outer end 135 of the left lower peripheral concavity 130 is joined by a left side member 180 to the outer end 165 of the left upper peripheral concavity 160. In other embodiments the section between the upper, outer ends 155, 165 may be straight, omitting concavities entirely. The concavities may be curved as already described, or rectangular, triangular, or any other shape that is deemed desirable. The right and left side members may be shaped to function as handles. In general, the section between the upper, outer ends 155, 165 is separated from the section between the lower, outer ends 125, 135 by a distance that spans a person's knee from a point below mid-femur and above the knee to a point above mid-tibia and below the knee.

Figure 2:
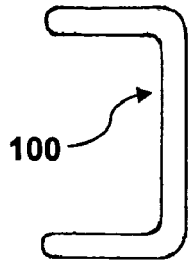
FIG. 2 shows a side elevation view of the embodiment of FIG. 1.
Figure 3:
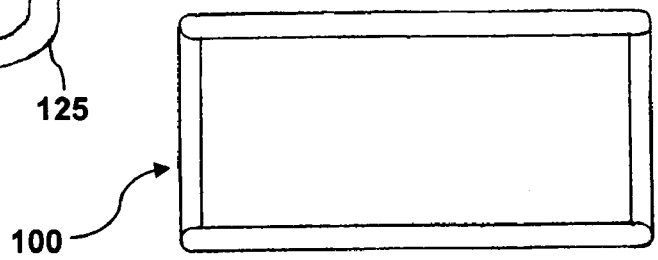
FIG. 3 shows a front elevation view of the embodiment of FIG. 1.
Figure 4:
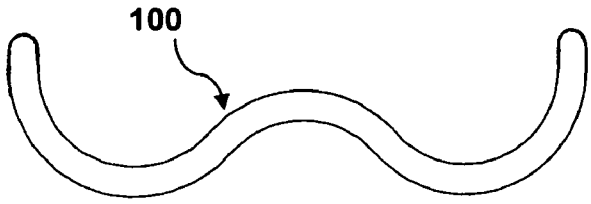
FIG. 4 shows a top plan view of the embodiment of FIG. 1.
Figure 5:
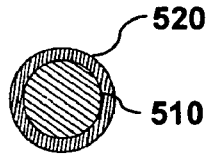
FIG. 5 shows a cross-sectional view of the embodiment of FIG. 1.

FIG. 2 shows a side elevation view of the embodiment of FIG. 1. FIG. 3 shows a front elevation view of the embodiment of FIG. 1. FIG. 4 shows a top plan view of the embodiment of FIG. 1. FIG. 5 shows a cross-sectional view of the embodiment of FIG. 1. Other embodiments may have oval, square, rectangular, or other known cross-sectional shapes. The embodiment of FIG. 5 has a solid core 510 with an outer layer 520 of non-absorbent, easily-cleaned, slip-resistant closed-cell synthetic foam or other known cushioning material surrounding the tubing. Other embodiments may be fabricated from hollow or internally reinforced tubing.

The embodiment 100 of FIG. 1 can be made of metal, fiberglass, plastic, composite materials, and/or other materials known in the art. Although the embodiment 100 of FIG. 1 is formed from a continuous length of stock joined at some convenient point to form a loop, other embodiments can be made of discrete components that may use button locks, screws, nuts and bolts, and other known fastening systems to attach to or interlock with each other, and to telescope in and out of each other.

An embodiment with discrete components may be disassembled for easy transport and may be resized by substitution of components. Telescoping components may allow incremental or continuous adjustments of the size and proportions of the invention. Another embodiment may be created from a flat panel that is cast, molded, or formed to have a central concavity with two opposing peripheral concavities. However, an open frame with a cushioned surface avoids pressure on kneecaps. Any embodiment is light and compact enough to be easily stored and transported by a mobile caregiver.

Figure 6:
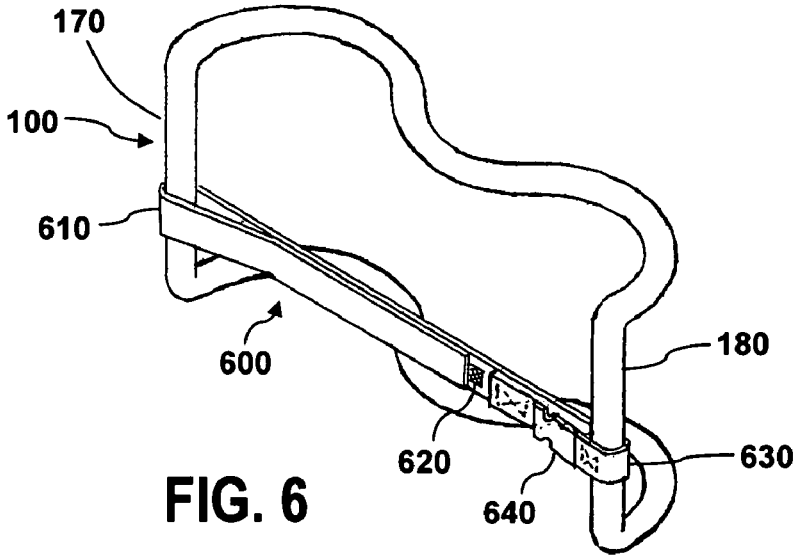
FIG. 6 shows an embodiment with an adjustable strap.
Figure 7:
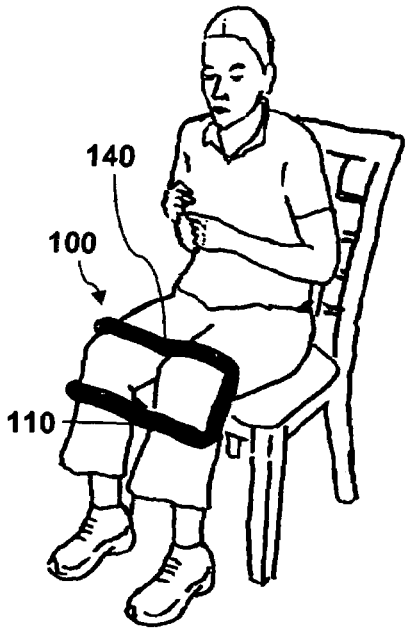
FIG. 7 shows a perspective view of a seated, two-legged patient with a frame positioned over the patient's knees.

FIG. 6 shows an embodiment 100 with an adjustable strap 600 used to secure the apparatus to a patient's legs. Although any embodiment may be used without a strap or other attachment system, attaching the apparatus simplifies certain aspects of use. One end of the strap comprises a loop 610 that passes around either the right 170 or left side member and is secured in place by hook and loop material 620. The other end of the strap comprises a second loop 630 that passes around the right or left 180 side member and is secured by a side release buckle 640 or other fastener known in the art.

Overall strap length may be adjusted by changing the length of the first loop 610. The strap may be quickly buckled and unbuckled by using the side release buckle 640 to open and close the second loop 630. The fastener is usually positioned on the patient's right side when a caregiver uses his or her right knee to push against the apparatus, and on the patient's left side when a caregiver uses his or her left knee to push against the apparatus. This allows for quick and easy access by the caregiver's hand (which can be safely freed), and positions the buckle on the side opposite the knee the caregiver uses to push against the apparatus.

FIGS. 7 through 13 show an exemplary method for using the embodiment of FIG. 1 to help a two-legged patient move from a sitting position to a standing position. Any embodiment may be used to accomplish this move in a similar manner. The embodiment of FIG. 1 is placed over the knees of a seated patient with the upper central concavity 140 above and between the knees, the lower central concavity 110 below and between the knees, and the peripheral concavities 120, 130, 150, 160 cradling the knees. In an embodiment with no upper concavities, the lower concavities 110, 120, 130 are again placed below the knees.

Figure 8:
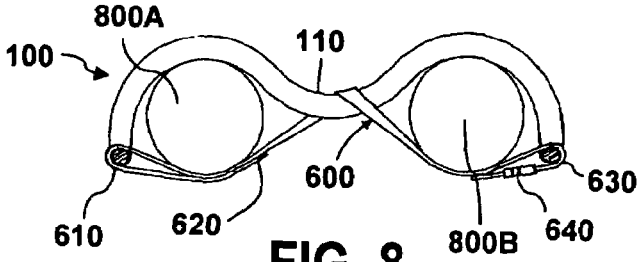
FIG. 8 shows a top cross-sectional view of the embodiment of FIG. 1 attached to a two-legged patient's legs.

FIG. 8 shows a top cross-sectional view of the embodiment of FIG. 1 attached to a patient's legs. When a strap 600 is used to attach an embodiment to a two-legged patient, the strap 600 may be secured by looping one end 630 around a side member and fastening the buckle 640, passing the strap 600 behind a leg 800B, passing the strap 600 around the front of the lower central concavity 110, passing the strap 600 behind the other leg 800A, looping the other end 610 of the strap 600 around the other side member, and securing the hook-and-loop fastener 620 in a position that comfortably secures the embodiment. The strap 600 may later be quickly removed by releasing the buckle 640.

Figure 9:
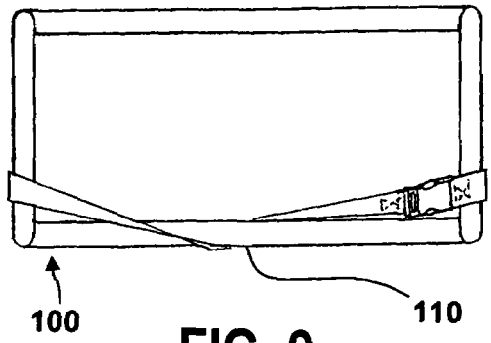
FIG. 9 shows a rear elevation view of the embodiment of FIG. 1 with the strap configuration of FIG. 8.

FIG. 9 shows a rear elevation view of the same attachment. This attachment method prevents the apparatus from slipping out of position and helps to keep the patient's knees within the peripheral concavities, so that the patient's knees are locked together for improved stability and safety.

Figure 10:
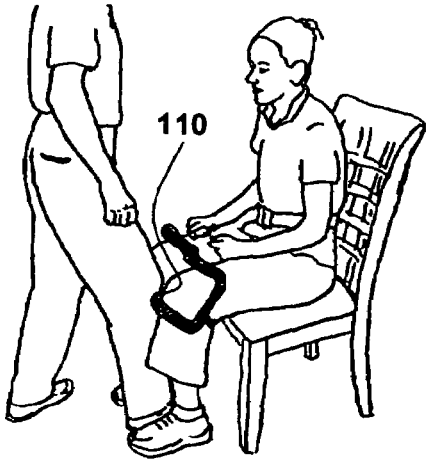
FIG. 10 shows a perspective view of a caregiver engaging the embodiment of FIG. 7.

Attached or not, once the apparatus is positioned on the patient's knees the standing caregiver faces the seated patient, places a supporting foot between the patient's feet in the manner shown in FIG. 10, then presses the caregiver's knee on the same side as the supporting foot into the lower central concavity 110. Since the caregiver's kneecap is now between and behind the patient's kneecaps, opposing pressure between the central concavity and the peripheral concavities tends to stabilize both the apparatus and the three knees pressed into the apparatus, with the knees in the peripheral concavities in effect balanced on and suspended from the knee supporting the central concavity.

This arrangement of force vectors produces a much higher degree of dynamic stability than could be obtained from an arrangement where the same set of knees are pressed against opposite sides of a flat panel or a strut. Moreover, the three knees are fixed in their respective positions and co-located closely enough to function as a single broad pivot or fulcrum with considerable side-to-side stability. With body weight fixing in place the caregiver's supporting foot and the patient's feet, and the apparatus fixing their knees together, a stable pillar supporting a pivot is created that allows the balancing body weights of the caregiver and patient to rock about the pivot.

The caregiver may gain a mechanical advantage by shifting body weight back from the pivot while drawing the patient's body weight close to the pivot. In this way even a relatively small caregiver may move a relatively large patient. The apparatus decreases the load on the neck, back, and extremities of the caregiver, thus reducing the likelihood of back injuries, musculoskeletal disorders, and work-related injuries. In addition to its other properties, the apparatus is easily grasped, so that a patient who has some arm strength may assist the caregiver by grasping the apparatus in the manner of a handle and pulling his or her upper body toward the caregiver, thus reducing the force the caregiver must apply to pivot the patient upward. The patient may also grasp the apparatus simply to maintain balance.

Figure 11:
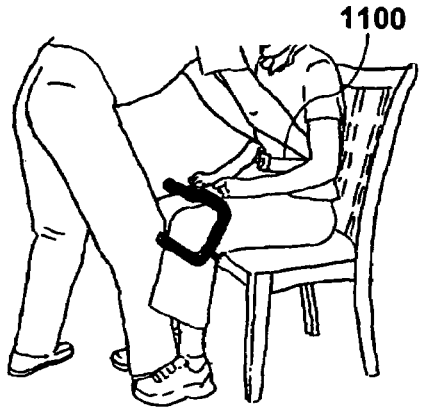
FIG. 11 shows a perspective view of a caregiver grasping a patient.
Figure 12:
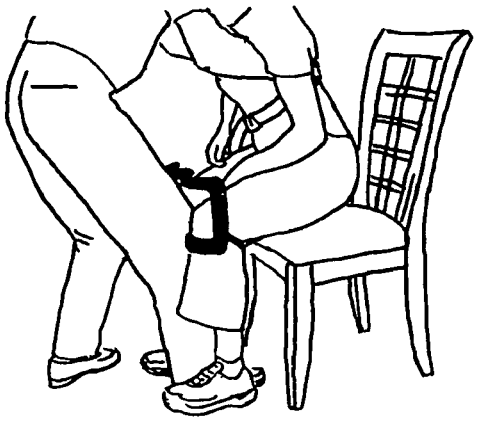
FIG. 12 shows a perspective view of a caregiver rocking a seated patient to a standing position.
Figure 13:
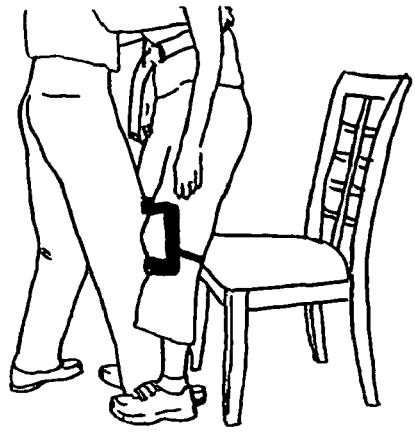
FIG. 13 shows a perspective view of a caregiver and patient in standing positions.

Reaching forward to grasp the patient as shown in FIG. 11, possibly by a belt 1100, the caregiver rocks his or her body weight back from the patient in the manner shown in FIG. 12, then pivots the patient forward and upward about the three knees to the standing position shown in FIG. 13. The caregiver usually achieves better control and mechanical advantage by grasping the patient as close to the hips as is feasible.

The same embodiments may be used in a similar fashion to assist a one-legged person or a two-legged person who cannot use one leg because of a non-weight-bearing fracture, cellulitis, or another disabling condition. It should be understood that references to and drawings of one-legged persons refer both to amputees and to two-legged persons who are unable to bear weight on one leg.

Figure 14:
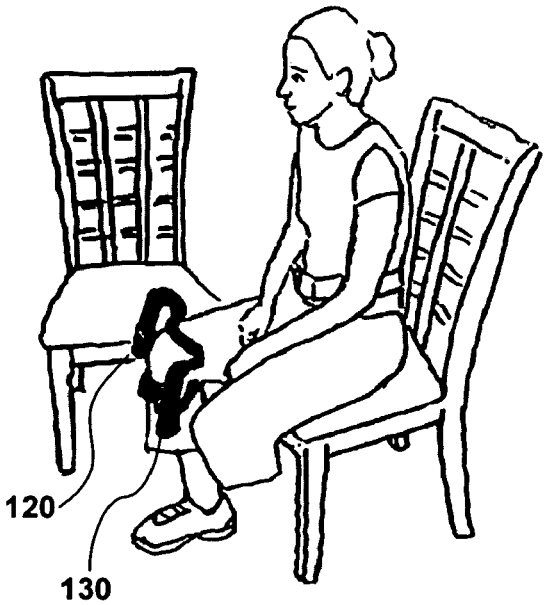
FIG. 14 shows a perspective view of an embodiment attached to a one-legged patient's leg.
Figure 15:
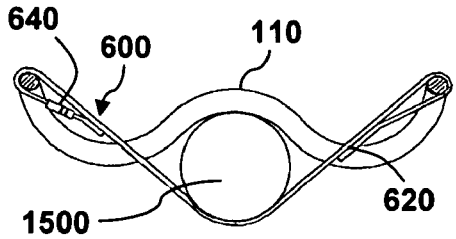
FIG. 15 shows a top cross-sectional view of the embodiment of FIG. 14 attached to a one-legged patient's leg.
Figure 16:
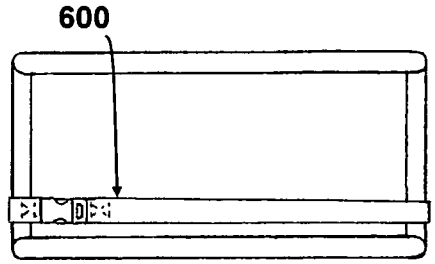
FIG. 16 shows a front elevation view of the embodiment of FIG. 15.

As shown in FIGS. 14 and 15, the apparatus is reversed and the lower central concavity 110 is positioned just below the knee of the patient's single leg 1500. If the apparatus is strapped on, the strap 600 is looped around one side member and the buckle 640 fastened, the strap 600 is passed behind the patient's leg 1500, then the strap 600 is passed around the opposite side member and the hook-and-loop fastener 620 secured as shown in FIG. 15. FIG. 16 shows a front elevation view of the strap configuration of FIG. 15.

Figure 17:
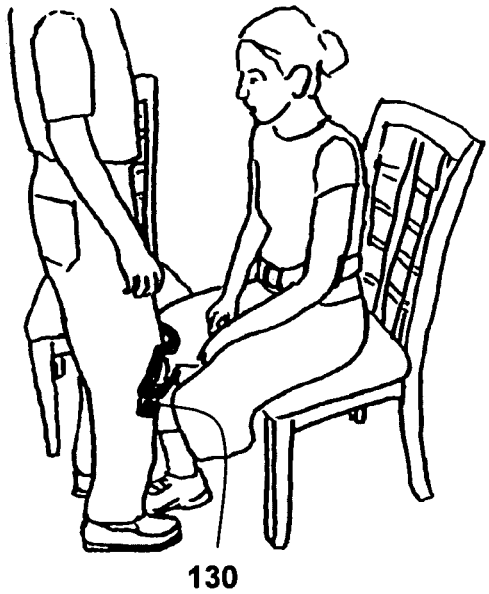
FIG. 17 shows a perspective view of a caregiver engaging the embodiment of FIG. 14.
Figure 18:
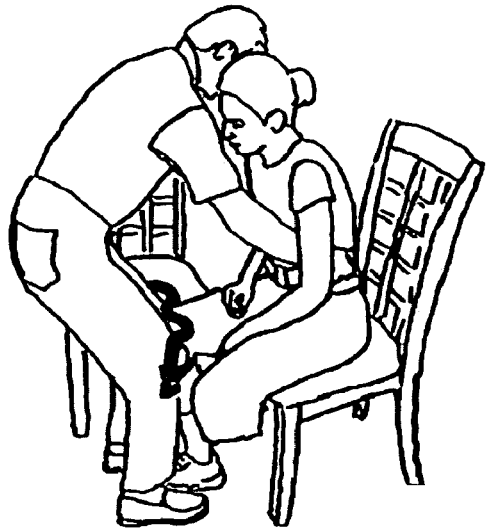
FIG. 18 shows a perspective view of a caregiver grasping a patient.
Figure 19:
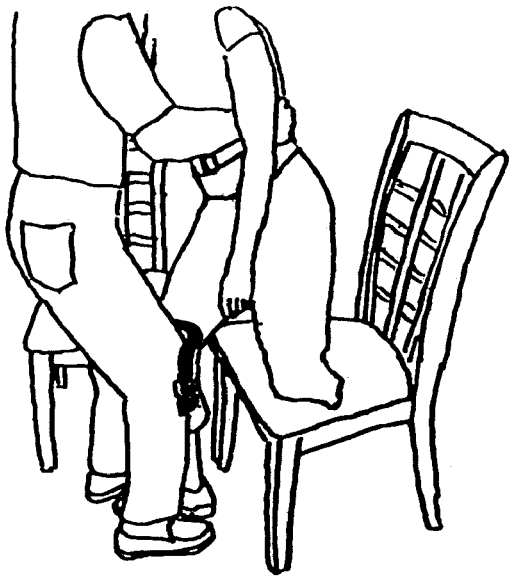
FIG. 19 shows a perspective view of a caregiver rocking a seated one-legged patient to a standing position.
Figure 20:
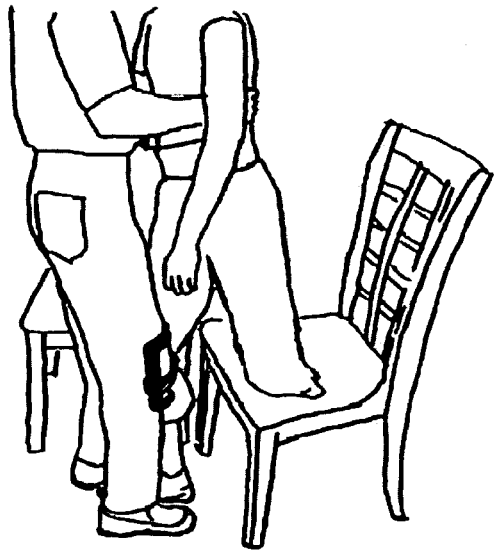
FIG. 20 shows a perspective view of a caregiver and patient in standing positions.

A caregiver faces the patient and places his or her feet on either side of the foot on the patient's only supporting leg, at least partially straddling the patient's foot. The caregiver's knees are pressed into the lower peripheral concavities 120, 130 as shown in FIG. 17. The caregiver grasps the patient, possibly in the manner shown in FIG. 18, then the caregiver rocks his or her weight backwards, causing the patient to pivot forward and rise to a standing position as shown in FIGS. 19 and 20.

Figure 21:
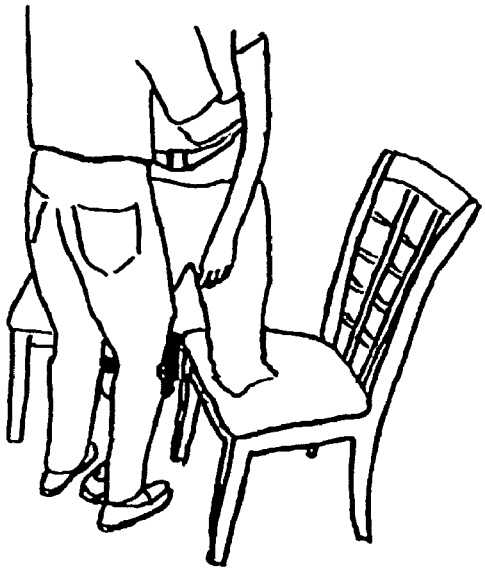
FIGS. 21 and 22 show perspective views of a caregiver rotating a standing one-legged patient to a new seat.
Figure 22:
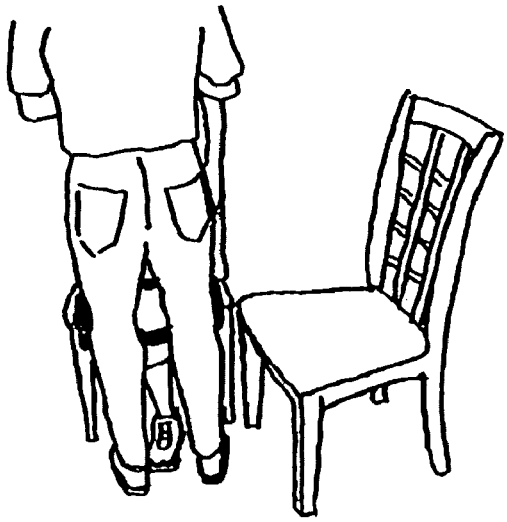
Figure 23:
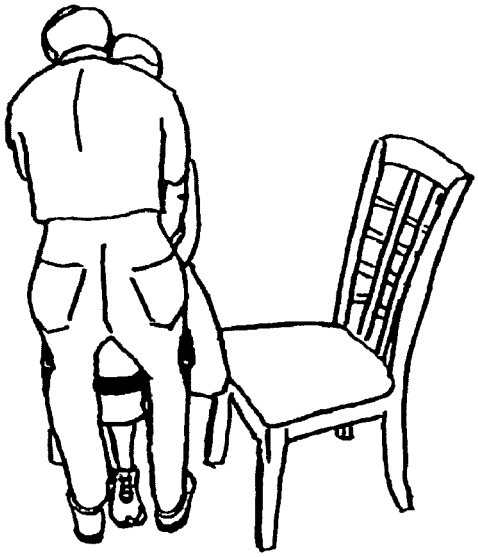
FIG. 23 shows a perspective view of a caregiver lowering a one-legged patient to a new seat.
Figure 27:
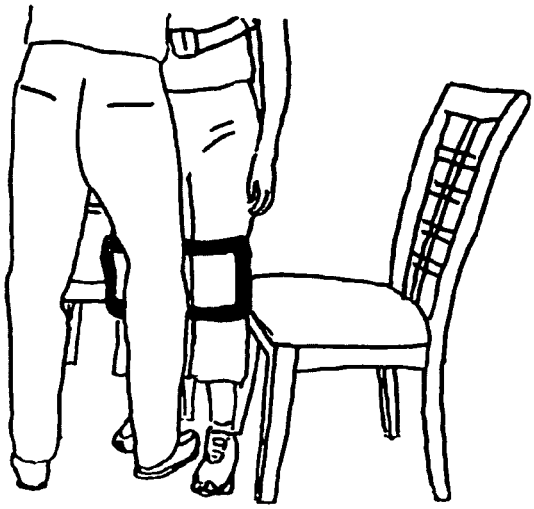
FIGS. 27 and 28 show perspective views of a standing two-legged patient being rotated between adjacent chairs.
Figure 28:
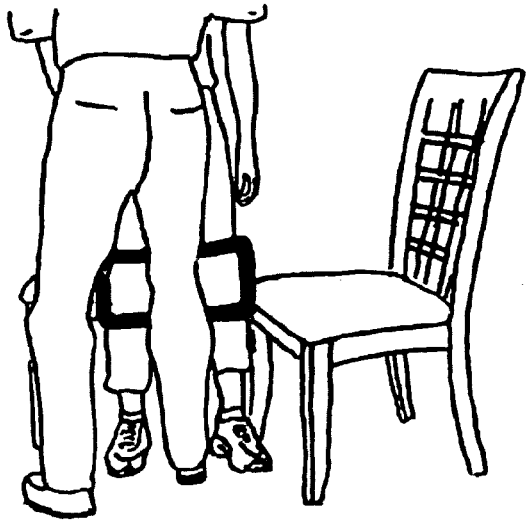

Once the patient is standing the patient may move or be moved in a variety of ways. FIGS. 21 and 22 show an operation where the standing patient of FIG. 20 is rotated from one chair to another. Once the patient is correctly positioned with respect to the new chair, the caregiver reverses the standing process by balancing the patient's weight with the caregiver's weight, then rocks forward to ease the patient into the new chair as shown in FIG. 23. As shown in FIGS. 27 and 28, the same shift may be accomplished for a two-legged patient using the method for standing already described, rotating the patient to the new chair, then reversing the two-legged assisted stand to ease the patient into a new seated position.

In some cases it is desirable to shift the patient's position without having the patient stand completely. This is often the case where the patient is so obese that the caregiver is unable to raise the patient or uncertain as to whether the patient would be stable if raised. In this situation the caregiver may use either the one-legged or two-legged method to raise the patient enough to slide the patient laterally between a bed and chair or other supporting surfaces. The apparatus may be used in conjunction with a sliding board, transfer disk, transfer belt (gait belt) or similar device.

Figure 24:
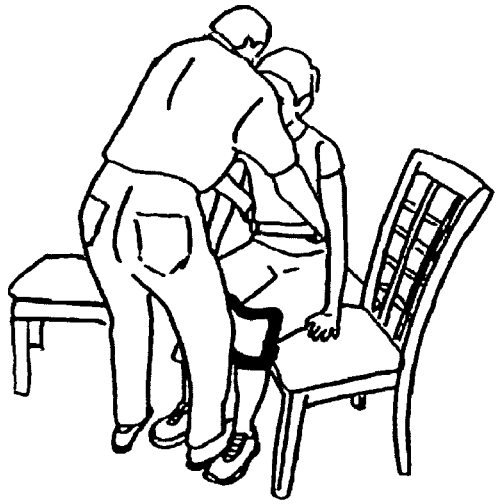
FIGS. 24 and 25 show perspective views of a caregiver sliding a two-legged patient from a chair to a bed.
Figure 25:
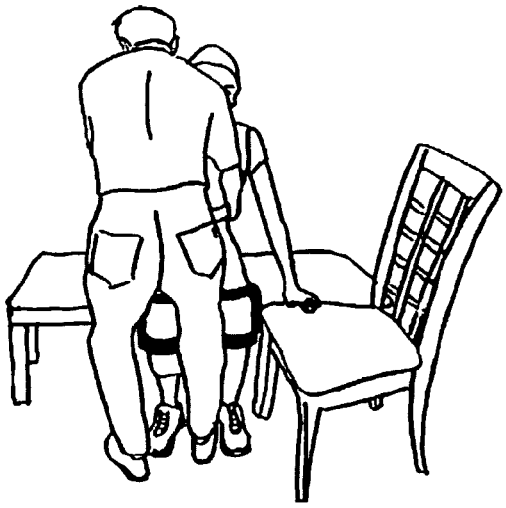
Figure 26:
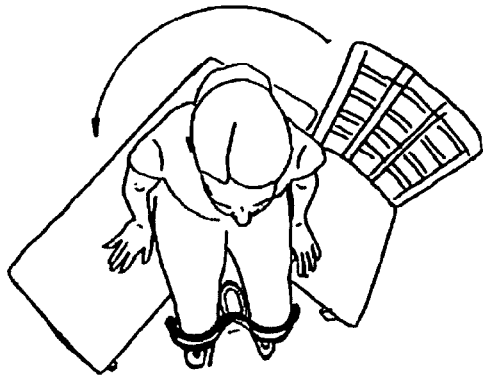
FIG. 26 shows a top plan view of the motion of a two-legged patient being slide from a chair to a bed.

FIGS. 24 and 25 show a caregiver shifting a two-legged patient from a chair to a bed. As shown in FIG. 24, the patient is lifted from the chair just enough to slide freely. The patient is rotated laterally to the bed, as shown in FIG. 25, then eased down onto the bed. FIG. 26 shows a top plan view of the motion of the shifted patient. The same shift may be accomplished for a person with only one weight-bearing leg using methods described above. Once any of the movements described above is accomplished the apparatus may be quickly removed by releasing the strap buckle.

Any embodiment of the invention may also be used as a tool for handling stroke patients and other persons who may not need to change position but require assistance during medical or therapeutic procedures. Any embodiment of the invention may be used to assist during rehabilitation, with maintenance of sitting or standing balance or certain postures, to facilitate trunk control and arm functions while dressing, with feeding, and during other activities. Any embodiment of the invention may be used to ensure that a patient will not slide off the edge of a bed. In any of these circumstances an embodiment of the apparatus is positioned on the patient and used in a manner described above, with the differences that the patient may be lifted only slightly or not at all, and the caregiver may grasp the patient in a manner that is not advantageous for lifting but more suited to balance or posture adjustment.

The apparatus and methods described above allow caregivers to maintain good balance, close contact and optimum control while moving patients. The principles, embodiments, and modes of operation of the present invention have been set forth in the foregoing specification. The embodiments disclosed herein should be interpreted as illustrating the present invention and not as restricting it. The foregoing disclosure is not intended to limit the range of equivalent structure available to a person of ordinary skill in the art in any way, but rather to expand the range of equivalent structures in ways not previously contemplated. Numerous variations and changes can be made to the foregoing illustrative embodiments without departing from the scope and spirit of the present invention.

We claim:

1. An apparatus for handling a person, comprising a frame, a lower portion of the frame having a central concavity, a first peripheral concavity, and a second peripheral concavity, the first and second peripheral concavities connected to opposite sides of the central concavity and opening to a first direction, the central concavity opening to the opposite direction, each concavity sized and shaped to comfortably accept a human knee, the first and second peripheral concavities disposed with respect to the central concavity so that a knee inserted in the central concavity is a least partially between two knees inserted in the first and second peripheral concavities, an upper portion of the frame substantially parallel to the lower portion of the frame, the upper portion of the frame separated from the lower portion of the frame by a distance sufficient to span a person's knee from a point below mid-femur and above the knee to a point above mid-tibia and below the knee.

2. An apparatus for handling a person as claimed in claim 1, wherein the frame is fabricated from tubing and encased in cushioning material.

3. An apparatus for handling a person as claimed in claim 1, wherein the frame is fabricated from solid material and encased in cushioning material.

4. An apparatus for handling a person as claimed in claim 1, wherein the upper and lower portions of the frame are attached by hand-operated fasteners.

5. An apparatus for handling a person as claimed in claim 1, further comprising an adjustable strap.

6. An apparatus for handling a person as claimed in claim 5, wherein the adjustable strap has a first end loop formed by a releasable buckle and a second end loop formed by hook-and-loop components.

7. A method for raising a seated, two-legged first person, comprising:

placing a frame with first and second lower peripheral concavities against a first leg and a second leg of the first person, with the first leg at least partially inserted into the first lower peripheral concavity and the second leg at least partially inserted into the second lower peripheral concavity, the first leg contacting the first lower peripheral concavity at a point between the first leg's knee and mid-tibia, the second leg contacting the second lower peripheral concavity at a point between the second leg's knee and mid-tibia;

positioning a standing second person directly in front of and facing the first person;

the second person placing a supporting foot at least partially between the first person's feet and at least partially inserting the lower leg attached to the supporting foot into a lower central concavity disposed between the lower peripheral concavities on the frame, with the lower leg attached to the supporting foot contacting the lower central concavity at a point between the knee and mid-tibia of the lower leg attached to the supporting foot; and the second person raising the first person to a desired position by exerting force on the upper body of the first person to pull the first person toward the second person while the second person simultaneously rocks away from the first person to balance a portion of the combined weight of the first person and the second person upon the legs at least partially inserted into the frame.

8. The method of claim 7, comprising an additional step wherein the frame is strapped to the legs of the first person before the second person inserts a leg into the frame.

9. The method of claim 7, comprising an additional step wherein the second person rotates the first person to a new seat.

10. The method of claim 7, comprising an additional step wherein the second person slides the first person laterally to a new seat.

11. The method of claim 7, comprising the additional steps of looping a first end of a strap around a first frame side member to create a first loop, fastening the first loop with a releasable fastener, passing the strap over the side of the first leg opposite the frame, passing the strap around the lower central concavity, passing the strap over the side of the second leg opposite the frame, looping a second end of the strap around a second frame side member to create a second loop, and fastening the second loop with a releasable fastener.

12. A method for seating a standing, two-legged first person, comprising:

placing a frame with first and second lower peripheral concavities against the first leg and the second leg of the first person, with the first leg at least partially inserted into the first lower peripheral concavity and the second leg at least partially inserted into the second lower peripheral concavity, the first leg contacting the first lower peripheral concavity at a point between the first leg's knee and mid-tibia, the second leg contacting the second lower peripheral concavity at a point between the second leg's knee and mid-tibia;

positioning a standing second person directly in front of and facing the first person;

the second person placing a supporting foot at least partially between the first person's feet and at least partially inserting the lower leg attached to the supporting foot into a lower central concavity disposed between the lower peripheral concavities on the frame, with the lower leg attached to the supporting foot contacting the lower central concavity at a point between the knee and mid-tibia of the lower leg attached to the supporting foot;

the second person lowering the first person by exerting force on the upper body of the first person to prevent the first person from falling backward while the second person simultaneously rocks toward the first person and balances a portion of the combined weight of the first person and the second person upon the legs inserted into the frame; and the second person continuing to rock toward the first person until the first person is seated.

13. The method of claim 12, comprising an additional step wherein the frame is strapped to the legs of the first person before the second person inserts a leg into the frame.

14. A method for raising a seated first person with one weight-bearing leg, comprising:

placing a frame with lower central concavity against the weight-bearing leg of the first person, with the weight-bearing leg at least partially inserted into the lower central concavity and contacting the lower central concavity at a point between the weight-bearing leg's knee and mid-tibia;

positioning a standing second person directly in front of and facing the first person;

the second person straddling a weight-bearing foot attached to the first person's weight-bearing leg by placing a first supporting foot on a first side of the first person's weight-bearing foot and a second supporting foot on a second side of the first person's weight-bearing foot;

the second person at least partially inserting the lower leg attached to the first supporting foot into a first lower peripheral concavity on the frame disposed on a first side of the lower central concavity, the lower leg attached to the first supporting foot contacting the first lower peripheral concavity at a point between the knee and mid-tibia of the lower leg attached to the first supporting foot;

the second person at least partially inserting the lower leg attached to the second supporting foot into a second lower peripheral concavity on the frame disposed on a second side of the lower central concavity, the second side of the lower central concavity opposite the first side of the lower central concavity, the lower leg attached to the second supporting foot contacting the second lower peripheral concavity at a point between the knee and mid-tibia of the lower leg attached to the second supporting foot; and the second person raising the first person to a desired position by exerting force on the upper body of the first person to pull the first person toward the second person while the second person simultaneously rocks away from the first person to balance a portion of the combined weight of the first person and the second person upon the legs inserted into the frame.

15. The method of claim 14, comprising an additional step wherein the frame is strapped to the weight-bearing leg of the first person before the second person inserts the second person's legs into the frame.

16. The method of claim 14, comprising an additional step wherein the second person rotates the first person to a new seat.

17. The method of claim 14, comprising an additional step wherein the second person slides the first person laterally to a new seat.

18. A method for seating a standing first person with one weight-bearing leg, comprising:

placing a frame with a lower central concavity against the weight-bearing leg of the first person, with the weight-bearing leg at least partially inserted into the lower central concavity and contacting the lower central concavity at a point between the weight-bearing leg's knee and mid-tibia;

positioning a standing second person directly in front of and facing the first person;

the second person straddling a weight-bearing foot attached to the first person's weight-bearing leg by placing a first supporting foot on a first side of the first person's weight-bearing foot and a second supporting foot on a second side of the first person's weight-bearing foot;

the second person at least partially inserting the lower leg attached to the first supporting foot into a first lower peripheral concavity on the frame disposed on a first side of the lower central concavity, the lower leg attached to the first supporting foot contacting the first lower peripheral concavity at a point between the knee and mid-tibia of the lower leg attached to the first supporting foot;

the second person at least partially inserting the lower leg attached to the second supporting foot into a second lower peripheral concavity on the frame disposed on a second side of the lower central concavity, the second side of the lower central concavity opposite the first side of the lower central concavity, the lower leg attached to the second supporting foot contacting the second lower peripheral concavity at a point between the knee and mid-tibia of the lower leg attached to the second supporting foot;

the second person lowering the first person by exerting force on the upper body of the first person to prevent the first person from falling backward while the second person simultaneously rocks toward the first person and balances a portion of the combined weight of the first person and the second person upon the legs at least partially inserted into the frame; and the second person continuing to rock toward the first person until the first person is seated.

19. The method of claim 18, comprising an additional step wherein the frame is strapped to the weight-bearing leg of the first person before the second person inserts legs attached to supporting feet into the frame.

* * * * *